United States Patent [19]

Paolini

[11] Patent Number: 4,564,982

[45] Date of Patent: Jan. 21, 1986

[54] CLASP FOR A BRACELET OR THE LIKE

[75] Inventor: Jean Paolini, La Chaux-de-Fonds, Switzerland

[73] Assignee: Fabrique Ebel SA, Switzerland

[21] Appl. No.: 632,032

[22] Filed: Jul. 18, 1984

[30] Foreign Application Priority Data

Feb. 23, 1984 [CH] Switzerland ..... 891/84

[51] Int. Cl.[4] ..... A44B 21/00

[52] U.S. Cl. ..... 24/71 J; 24/68 J; 24/68 E

[58] Field of Search ..... 24/33 R, 33 P, 68 R, 24/68 J, 68 E, 68 CD, 71 J, 327, 170, 193, 197, 265 BC

[56] References Cited

U.S. PATENT DOCUMENTS

| | | | |
|---|---|---|---|
| 1,612,395 | 12/1926 | Osborne . | |
| 1,689,640 | 10/1928 | Newman | 24/71 J |
| 1,778,313 | 10/1930 | Darling | 24/68 E |
| 4,330,905 | 5/1982 | Wolfgang | 24/68 J X |

FOREIGN PATENT DOCUMENTS

| | | | |
|---|---|---|---|
| 1462999 | 11/1966 | France | 24/68 J |
| 2300518 | 9/1976 | France . | |
| 2422353 | 4/1978 | France | 24/71 J |
| 650505 | 12/1962 | Italy | 24/68 J |
| 576761 | 6/1976 | Switzerland . | |
| 596794 | 3/1978 | Switzerland . | |
| 870760 | 6/1961 | United Kingdom . | |

*Primary Examiner*—William E. Lyddane
*Assistant Examiner*—Laurie K. Cranmer
*Attorney, Agent, or Firm*—Bacon & Thomas

[57] ABSTRACT

A clasp for a bracelet or similar device including first and second arms hinged for pivotal movement between open and closed positions, wherein a buckle carried by the first arm adjustably receives the end of a first strap therethrough, the free end of the first strap being inserted through an opening provided in the first arm and concealed under a second strap connected to the second arm when the arms are disposed in the closed position.

5 Claims, 2 Drawing Figures

CLASP FOR A BRACELET OR THE LIKE

One of the most frequent problems in jewelry is to supply elegant, convenient and strong clasps, especially for bracelets. The required qualities are hardly reconcilable. One of the most generally used materials for making bracelets is leather, because it is one of the most elegant ones. The most usual way to perform the closing of the clasp as well as the adjustment of its length consists in putting at the end of one of the straps a buckle, with or without a tongue, like a belt. Such a device presents the inconvenience of requiring several movements for the closing of the bracelet. Moreover, the end of the strap which protrudes from the buckle must usually be fixed by a loop, and the appearance of this protruding end is not very aesthetic. The advantage of such device is to allow a relatively easy adjustment of the length, though such adjustment must be made every time the bracelet is put on.

In order to facilitate the closing and to avoid the presence of a protruding strap end, there has been proposed, for example, clasps made of two arms, the end of each arm being pivotally fixed at an end of a strap, each arm being linked by its other end to an end of a third arm. The third arm having a length twice as long as the length of the two other arms, these latter arms being pivotal on their hinges for folding on the third arm, against which they apply and fasten; so the ends of the two straps meet in the middle of the third arm; the straps hiding the three arms, which are folded. The inconvenience of such a device lies in the fact that the length of the straps permanently adjusted so that it is only possible to shorten the bracelet by cutting the straps, whereby lengthening of the bracelet can only be accomplished by replacing the straps with longer straps.

This invention aims at providing a clasp which allows the adjustment of the length in a simple way and without it being necessary to adjust the length each time the bearer puts the bracelet on; the invention moreover avoids visibility of the protruding strap end, as is the case in conventional clasps with buckles.

The drawings show, as example, an embodiment of the invention.

Figure 1:
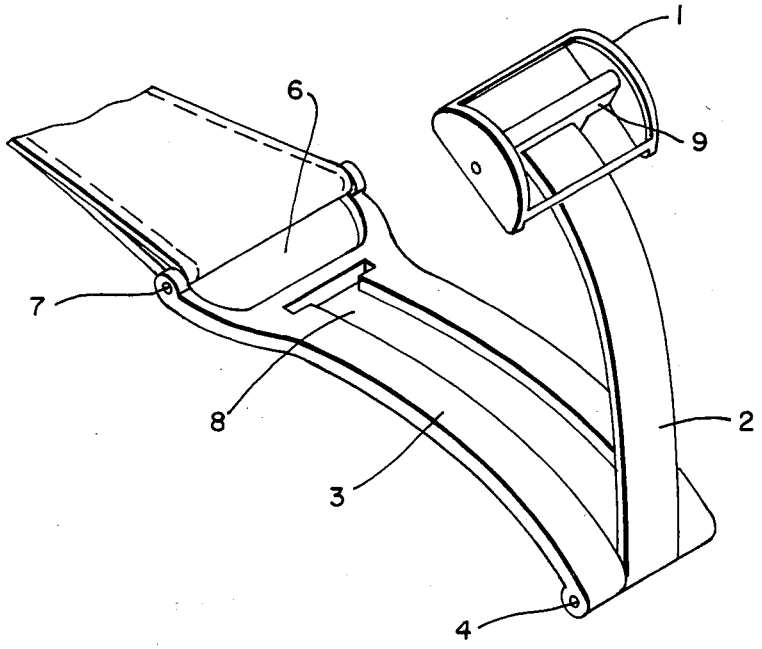
FIG. 1 is a perspective view of a clasp according to the invention, in open position, in which only one strap of the bracelet is partially represented.
Figure 2:
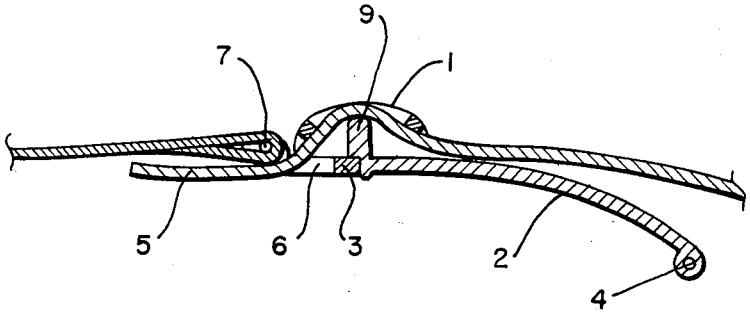
FIG. 2 is a longitudinal cross-section of a same clasp, in closed position, in which the two straps of the bracelet are partially represented.

The clasp comprises a buckle 1, and two arms 2 and 3. The two arms are connnected with each other by a hinge 4. The buckle 1 is pivotally mounted on a rung 9 which is fixed to the first arm 2. The second arm 3 is provided with a central longitudinal notch 8, the configuration of which corresponds to that of the first arm 2. In closed position, the first arm 2 is entirely received in notch 8, so that the thickness of the two folded arms 2 and 3 can be minimized.

The first strap is inserted through and fixed in the buckle 1; its end 5 protrudes from the buckle 1, towards the second strap. At its end, the second arm 3 has an opening 6. In the form of embodiment represented here, this opening has the form of a stirrup; it is closed by a pin 7 to which is fixed a second strap of the bracelet.

In order to close the clasp, it suffices to fold the arm 2 on the arm 3, and therefore to push the buckle towards the opening 6. The end 5 of the first strap attached to the buckle is inserted in the opening 6. When the clasp is closed, the buckle covers the opening 6 and places itself against the binding means of the second strap.

In that way, the end 5 is entirely hidden. The clasp is easy to handle: the bracelet can be closed in one single movement.

The length can be adjusted easily, and it is not necessary to make such adjustment each time the bracelet is put on the wrist.

In the form of embodiment represented here, the buckle has no tongue. This gives the bracelet, when closed, a greater purity of design. Nevertheless, it is possible to use a tongue.

Moreover, the second strap is fixed by a pin, which the strap sheathes, so that the strap is in contact with the buckle when the clasp is in closed position. However, it would be possible to use other fixing means, in which for example the strap would be enveloped and would therefore not get into contact with the buckle.

Finally, in the embodiment represented here, the clasp has two arms. It would however be possible to use, for example, three arms.

I claim:

1. A clasp for a bracelet or the like comprising:

(a) first and second arms, each arm having two ends, the arms being hinged to each other at a pair of corresponding ends for pivotal movement between open and closed positions;

(b) a buckle carried by the unhinged other end of the first arm, the buckle being configured to receive a first strap therethrough and adjustably fix one end of the first strap therein, whereby the free end of the first strap extends from the buckle;

(c) means carried by the unhinged other end of the second arm for securing a second strap thereto; and (d) the second arm including an opening through which the free end of the first strap may be received and concealed under the second strap when the first and second arms are disposed in the closed position.

2. The clasp of claim 1 wherein the second arm includes a notch within which the first arm is received when the arms are disposed in the closed position.

3. The clasp of claim 1 wherein the means carried by the second arm for securing the second strap includes a pin.

4. The clasp of claim 3 wherein the periphery of the opening for receiving the free end of the first strap is partially defined by the pin.

5. The clasp of claim 1 wherein the first arm includes a rung on which the buckle is supported, and both the rung and first arm are integrally formed together.

* * * * *